United States Patent [19]

Ruediger

[11] 4,344,110

[45] Aug. 10, 1982

[54] SUPPLEMENTAL IDENTIFICATION SYSTEM FOR CHANNEL AND SIMILAR MARKER LIGHTS

[76] Inventor: Dennis W. Ruediger, Slipp 111 Keehi Marina, Honolulu, Hi. 96819

[21] Appl. No.: 108,442

[22] Filed: Dec. 31, 1979

[51] Int. Cl.[3] ..... F21Y 7/04; F21P 1/02; B63B 21/52

[52] U.S. Cl. ..... 362/32; 362/123; 441/16

[58] Field of Search ..... 9/8.3; 362/157, 158, 362/32, 123

[56] References Cited

U.S. PATENT DOCUMENTS

| | | | |
|---|---|---|---|
| 1,791,794 | 2/1931 | Chesney | 362/32 X |
| 2,387,816 | 10/1945 | Wagner | 362/32 |
| 2,586,791 | 2/1952 | Dattilo | 362/123 X |
| 2,614,203 | 10/1952 | Dalton et al. | 362/32 |
| 2,717,336 | 9/1955 | Craddock | 362/123 X |
| 3,253,138 | 5/1966 | Nagel | 9/8.3 R X |
| 3,264,463 | 8/1966 | Bonner | 362/158 |
| 3,435,206 | 3/1969 | Swanson | 362/183 |
| 3,578,973 | 5/1971 | Dooley et al. | 362/32 X |
| 3,605,149 | 9/1971 | Keats | 9/8.3 E |
| 3,790,775 | 2/1974 | Rosenblatt | 362/32 X |
| 4,060,722 | 11/1977 | Foley | 362/123 X |
| 4,151,582 | 4/1979 | Grunberger | 362/32 X |

FOREIGN PATENT DOCUMENTS

| | | | |
|---|---|---|---|
| 500455 | 3/1954 | Canada | 362/123 |

*Primary Examiner*—Donald A. Griffin
*Attorney, Agent, or Firm*—James C. Wray

[57] ABSTRACT

A channel marker includes signals which are unique so that the identity of a marker is readily apparent even against background lighting. The signals may include lights, prisms, lenses, luminescent strips and reflectors. The number and disposition of the signals further identify a marker. Photo-voltiac means can recharge batteries.

41 Claims, 10 Drawing Figures

10'
56
16'
52
60
50
54
14'
62
26
12
V'
H'
64
66

44
42e
44
42d
44
42c
44
42b
44
42a
22
12
S
H 10
18
16
44
40
42
36
30
14
44
42
32
22
26
12
34

SUPPLEMENTAL IDENTIFICATION SYSTEM FOR CHANNEL AND SIMILAR MARKER LIGHTS

REFERENCES CITED

U.S. Patents

U.S. Pat. No. 543,730—7/1895, Heap, --
U.S. Pat. No. 1,759,368—5/1930, Piron, --
U.S. Pat. No. 2,092,664—9/1937, Bray, 177/329
U.S. Pat. No. 2,344,221—3/1944, Trautner, 240/22
U.S. Pat. No. 3,253,138—5,1966, Nagel, 240/11-2

BACKGROUND OF THE INVENTION

The present invention relates in general to markers, and, more particularly, to channel markers. The presently known systems of lights which are used to mark the edges of harbor entrance channels or other waterways utilize a series of slowly flashing lights. The lights are colored to indicate sides of the channel, and the lights may be mounted on buoys or posts. These lights represent a standardized, readily maintained system in wide use throughout the world. However, to the pilot of a vessel, especially one inbound to a port with a myriad of other lights within his field of vision as now present in urban areas, currently used marker lights are easily confused with other lights, often resulting in hazardous or difficult navigation of the vessel.

While lighted markers are well known, all of these known markers have similar shapes and produce lights which are not clearly and easily distinguishable from land based lights. Furthermore, none of these known markers has a sequential operation of lights within the marker to render it distinct from other lights.

SUMMARY OF THE INVENTION

The teachings of the present invention are embodied in a channel marker which is easily distinguished from other lights in an area or background.

The marker may include direct, reflective, diffusive, prismatic, or other type of signaling means, such as optical fiber, and one form of the marker has lights which are sequentially operated. Signaling means include one or more light sources and means to emit light from a vertically elongated marker body in areas which are vertically displaced along the body. The light emitted covers 360 degrees in a horizontal plane about the marker. Other forms of the marker include luminescent material or the like so arranged as to enhance the visibility and identifiability of the marker. The marker of the present invention is designed to be readily distinguishable from background lights. A principal factor to achieve this is elongating means included in most forms of the marker to vertically extend or give the effect of vertically extending the source of light.

Light distribution in the device of the present invention is based primarily on either (I) direct radiation from a vertically disposed source(s) or (II) (a) a source in the base, vertically directed; (b) means to redirect the beam(s) in a vertically distributed, omnidirectional horizontal pattern. This may be accomplished by stepped cylindrical reflectors with each reflector shaped so as to concentrate the light rays through a fresnel lens or other distributor as desired, or by refraction by prisms. Either form may be aligned with a series of fresnel lens arrays to concentrate beams in horizontal planes. An interior conical reflector is used in one form of the invention to aid in the distribution.

Light beam concentration in the vertical direction toward the reflectors is aided by a reflector at the base of a lamp used in the marker.

One form of this invention includes an illuminated vertically stacked segment(s) having a phospher energized by the flash of a primary lamp(s) and the segment(s) is thus illuminated between flashes of the primary source. A further alternative form includes a low-intensity gas discharge tube, such as a fluorescent lamp, (with back-up bulb), vertically disposed within the device and energized separately of the primary light source. Since the fluorescent tube has a long, finite life, it is suitable for marker use, and its low power consumption renders it compatible with buoy operation.

Identification of a specific marker is an important factor in channel entrances. In the daytime, this identification can be accomplished by a number on the marker. The markers of the present invention also include night time identification means. Some markers have a physical protuberance, with an additional light if needed. The parameters which can be varied to transmit information by the protuberances include: the number of such protuberances or lights; the position of such protuberances or lights; and the shape of protuberances. Back-up incandescent sources are provided similar to those in present use. Photo-voltaic cells may be incorporated to recharge a battery system, and would be mounted on an adjacent portion of the base.

OBJECTS OF THE INVENTION

It is primary object of the present invention to provide a marker light which is clearly distinctive from other lights and thus avoid confusion.

It is another object of the present invention to provide identification of an individual marker.

It is yet another object of the present invention to provide an improved marker which is compatible with maritime law and maritime power supplies so as to be compatible with existing markers.

It is yet another object of the present invention to incorporate photo-voltaic cells to help maintain battery charge.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 2:
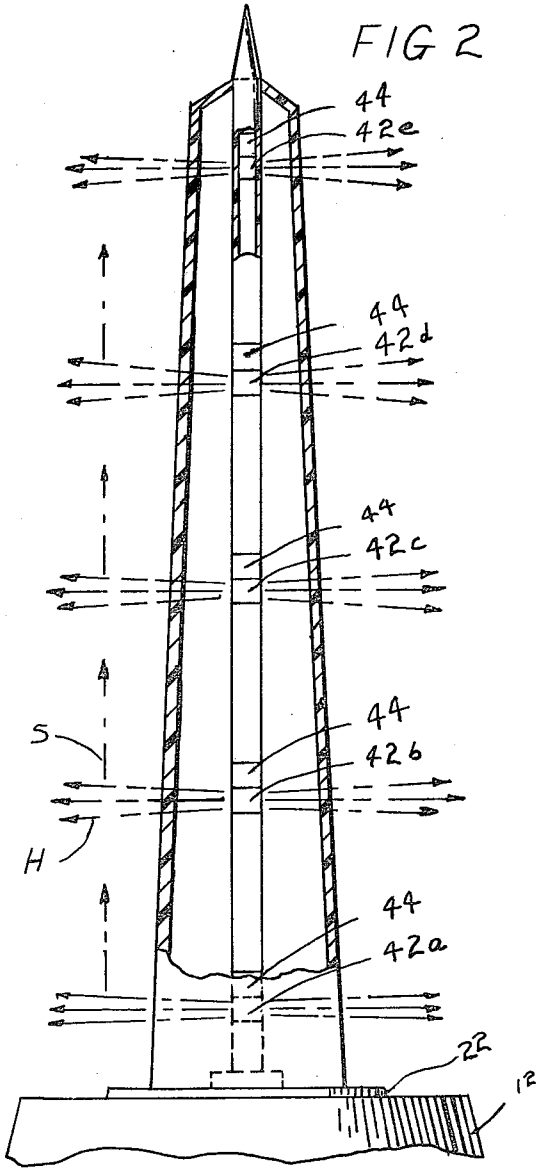
FIG. 2 is a partially sectional side elevation of the marker shown in FIG. 1.
Figure 1:
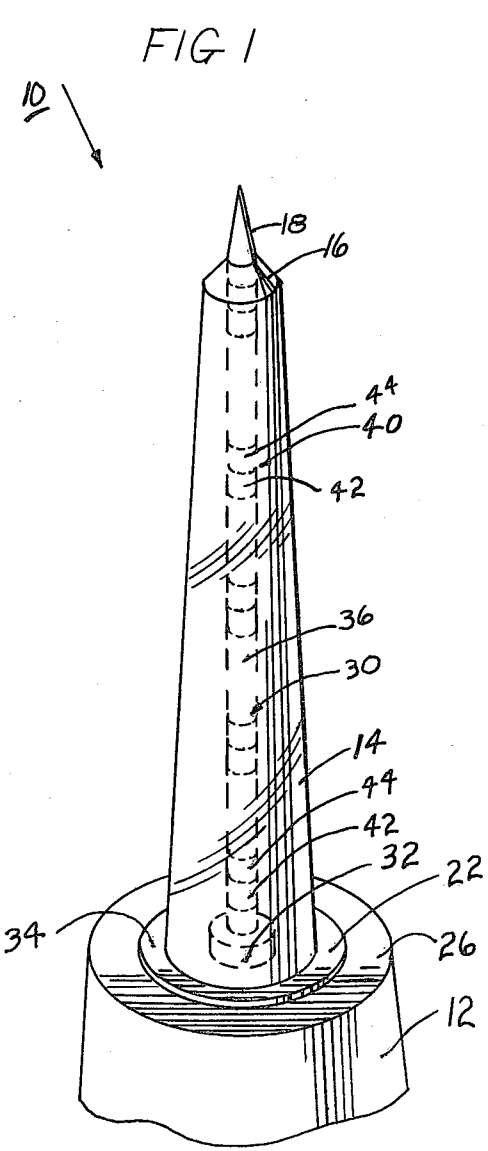
FIG. 1 is a perspective view of one form of the marker embodying the teachings of the present invention.

Shown in FIGS. 1 and 2 is a first form of a marker embodying the teachings of the present invention. The FIG. 1 marker is denoted by the reference numeral 10 and includes a base 12 and a frusto-conical body 14, topped by a frusto-conical cap 16 from which a conical bird spike 18 extends. An annular collar 22 surrounds the body 14 at the base thereof, and the body and collar are mounted on upper surface 26 of the base 12 to extend upwardly therefrom. The body is hollow and is mounted on the base 12 so that access to the interior of the body is possible for replacement and/or repair purposes.

An elongate mounting means 30 is located on the longitudinal central axis of the body 14 and the cap 16, which is also hollow. The mounting means 30 includes a base 32 mounted either on the surface 26 or on upper surface 34 of the collar 22, and an elongate cylindrical mounting body 36 extends upwardly from the base 32. The body 36 can terminate an abutting relationship with the lower end of the cap 16. The body 14 is preferably transluscent, and can be transparent if so desired.

A plurality of marker light sources 40 is mounted on the mounting means 30 and includes primary lights 42 and backup lights 44 in the form of the invention shown in FIGS. 1 and 2. The marker lights are preferably gas discharge lights. As with all other forms to be discussed below, the light emitted by the marker 10 is in a plane which is essentially horizontal and covers a 360° area about the marker.

As indicated by the arrows S in FIG. 2, the marker lights may be actuated sequentially or in unison. For example, the lowermost light 42*a* may be actuated first, followed by intermediate light 42*b* second, 42*c* third, and 42*d* fourth, followed by topmost light 42*e*. The lights are visible in a horizontal plane as indicated by the arrows H in FIG. 2. The repeated, sequential nature of the light actuation differentiates the buoy lights from background lights.

It is noted that FIGS. 1 and 2 show five pairs of lights. However, more or less lights could be used. Suitable control equipment (not shown) can be provided for controlling and powering the lights 40.

Figure 3:
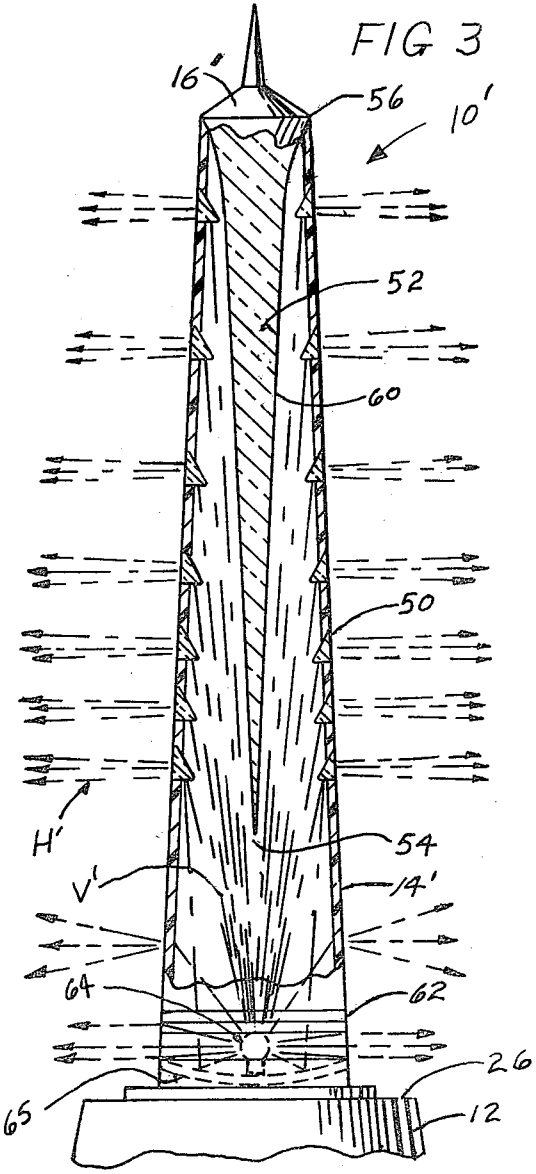
FIG. 3 is an elevation view of another form of the channel marker embodying the teachings of the present invention.

The lights 40 can be replaced by other signalling means. As indicated in FIGS. 3–8, various lights and/or prisms and/or reflectors can also be used in conjunction with the markers. As shown in FIG. 3, marker 10′ includes a base 12 and a frusto-conical main body 14′ mounted on upper surface 26 thereof to extend upwardly therefrom. A plurality of prisms 50 are mounted on the main body 14′, and a conical reflective cone 52 is mounted within the body 14′ so the apex 54 of the cone is downwardly directed, and the base 56 thereof is affixed to, the cap 16′. The cone 52 has an outer reflective surface 60 and has the longitudinal centerline thereof coincident with the longitudinal centerline of the main body. A Fresnel lens 62 may be located on the main body near the base thereof. A light source 64 is mounted within the main body, and a concave reflective mirror 65 is mounted sub-adjacent the light source 64. The mirror directs light upwardly within the main body and is focused so that light reflected thereby is incident upon the prisms 50. The prisms, as indicated in FIG. 3, redirect the light incident thereon from generally vertical to horizontal directions as indicated by the arrows V′ and H′, respectively, in FIG. 3.

Figure 4:
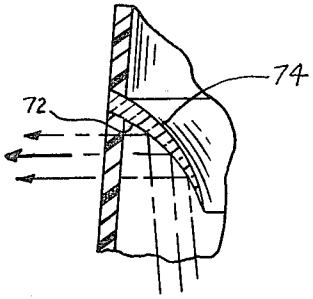
FIGS. 4 and 5 show reflective and prismatic means usable in the marker embodying the teachings of the present invention.

It is feasible to utilize a series of peripheral mirrors of reflective concave section 74, as shown in FIG. 4, to reflect rather than refract the vertically emitted light rays to the desired horizontal orientation. The mirrors 72 may also take a planar form.

Figure 5:
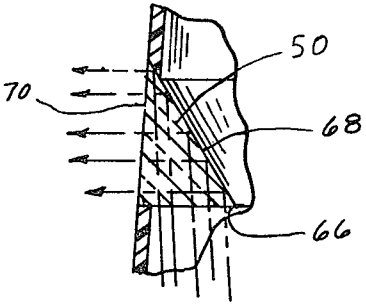

The annular prisms 50 are of a configuration best suited for light redistribution as shown in section in FIG. 5. In this form, light incident upon annular planar surface 66 from the source in the base is redirected by the sloped frusto-conical surface 68 and is emitted from the outer surface 70.

Figure 6:
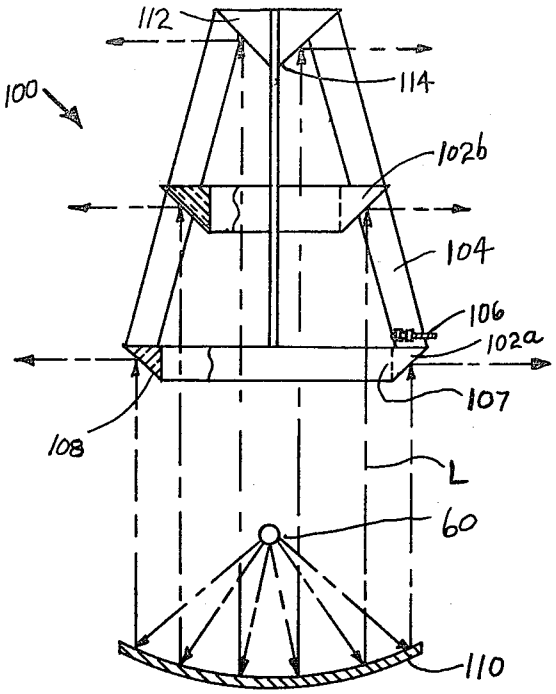
FIG. 6 is an elevation view of a reflective system usable in a channel marker embodying the teachings of the present invention.
Figure 7:
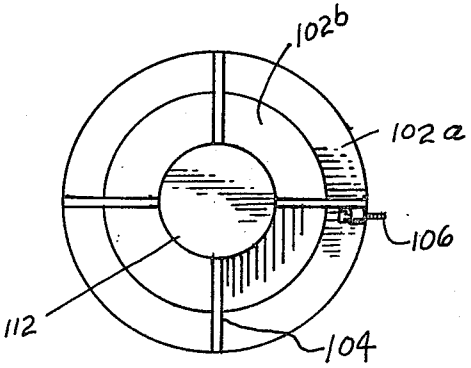
FIG. 7 is a top plan view of the FIG. 6 reflective system.

Yet another form of the light directing means is shown in FIGS. 6 and 7. The means includes a plurality of annular frusto-conical reflectors, such as 102*a* and 102*b*, which are each mounted on brackets 104, as by bolts 106, or the like, fixing bracket arms (not shown) to the brackets 104. Each of the reflectors 102 has an outer diameter selected so each reflector has a larger outer diameter than the superjacent reflector, and the step configuration shown in FIG. 7 is produced. Furthermore, each of the reflectors has an opening 107 through which light, indicated by arrows L, passes on the way to the superjacent reflector. The stepped configuration corresponds to the upward shape of the frusto-conical main body. A light source 60 is mounted in the main body, and a light reflector, such as concave mirror 110, is mounted in the marker to reflect light toward the reflectors 102, as indicated by the arrows in FIG. 6. A top reflector 112 is conical with the apex 114 thereof directed toward the base of the marker, and located along the longitudinal centerline thereof. The light source 60 is mounted on the main body longitudinal centerline.

Figure 8:
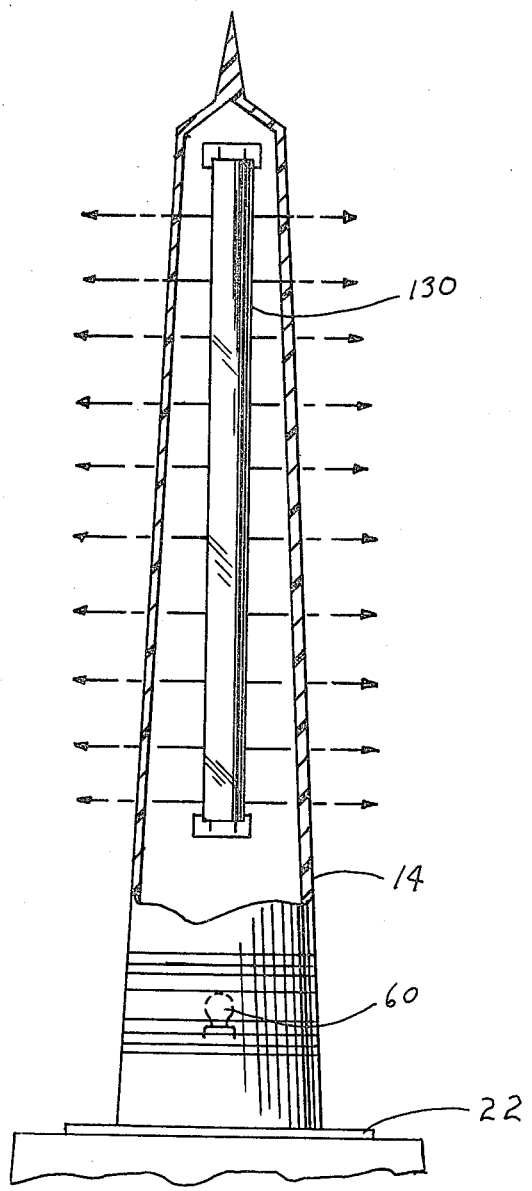
FIG. 8 is an elevation view of another form of a channel marker embodying the teachings of the present invention.

Yet another form of the invention is shown in FIG. 8 wherein the light source 60 is located within the main body of the marker, and redirective means (not detailed) is used as before to vertically distribute the light. In addition to the main light source, a low intensity light, such as fluorescent light 130, is located within the main body. The light 130 is elongated and is preferably oriented to be on the vertical centerline of the main body. The light 130 is energized separately from the light 60 and provides an illuminated vertical segment of the marker main body during the interval between the flashes of the main light source.

Figure 9:
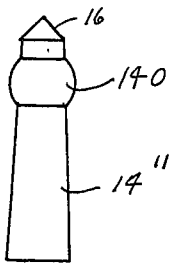
FIGS. 9 and 10 are elevation views of a portion of a channel marker embodying the teachings of the present invention.
Figure 10:
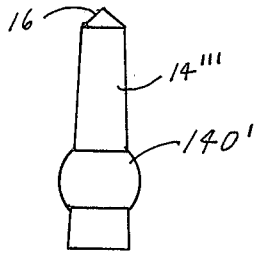

Identification of the marker can be augmented by altering the shape of the marker as indicated in FIGS. 9 and 10. Thus, as shown in FIG. 9, an arcuate physical protuberance 140 can be located near the top of the marker body 14″ to indicate a particular marker location or the like. A light, or redirecting means, such as a prism, can be located within the protuberance 140 to further call attention to that protuberance. A next marker can have the protuberance near the center thereof, and the last marker can have the protuberance near the bottom of body 14‴, as shown in FIG. 10. The protuberance can be diamond-shaped, rectangular, or any other suitable shape.

In any embodiment, the length and sequence of each particular flash duration can also be adjusted to further distinguish the markers from background lights, or where possible the overall line of markers can be synchronized to provide a strobe effect common to airport runways. Further backup circuits can be added in case the backup circuits, such as the lights 44 of the FIG. 2 embodiment, fail.

As this invention may be embodied in several forms without departing from the spirit or essential characteristics thereof, the present embodiments are, therefore, illustrative and not restrictive.

I claim:

1. A marker comprising a base, an upright elongate main body mounted on said base, and signaling means in said body, said signaling means being disposed in an elongate vertical column within said body, said signaling means emitting original light uniformly from said main body continuously throughout 360 degrees in discrete visibly discernable spaced planes which are essentially horizontal so that the identity of the marker is readily apparent even against background lighting.

2. The marker defined in claim 1 wherein the signaling means further includes a primary light source in said main body.

3. The marker defined in claim 2 wherein the primary light source includes plural light sources.

4. The marker defined in claim 3 further including plural backup light sources.

5. The marker of claim 3 wherein the plural light sources are stacked plural light sources.

6. The marker of claim 3 wherein the plural light sources are connected for predetermined sequential operation.

7. The marker defined in claim 2 wherein said signaling means include a plurality of light redirecting means to redirect light emissions from said source into said spaced horizontal planes.

8. The marker defined in claim 7 wherein said redirecting means comprises plural reflectors mounted on said main body.

9. The marker defined in claim 2 wherein said signaling means incorporates vertically disposed lenticular lens.

10. The marker defined in claim 2 where said marker incorporates diffusive means in the body.

11. The marker defined in claim 2 wherein the signaling means include fiber optics to redirect light into horizontal planes.

12. The marker defined in claim 2 wherein the primary light source is of the gas discharge type.

13. The marker defined in claim 2 further comprising a cap on the main body and a bird spike on the cap and proceeding upward therefrom along a longitudinal center line of the marker.

14. The marker defined in claim 2 wherein control means causes said main light source to flash according to a predetermined program.

15. The marker defined in claim 2 further including vertically disposed luminescent material in said main body.

16. The marker defined in claim 2 wherein the primary light source is a high intensity light source and further comprising a low intensity light source.

17. The marker defined in claim 1 wherein said signaling means includes a plurality of vertically spaced signal light sources in elongate columnar arrangement.

18. The marker defined in claim 17 wherein said signal light sources include gas discharge lamps.

19. The marker defined in claim 17 wherein the signaling means further includes back-up light sources adjacent to said signal light sources.

20. The marker defined in claim 17 wherein the signaling means further comprises control means for causing said light sources to flash according to a predetermined sequence.

21. The marker defined in claim 20 wherein the control means causes the light sources to flash in a vertical sequence.

22. The marker defined in claim 17 wherein said signal light sources include incandescent lamps.

23. The marker defined in claim 17 wherein said light sources are so spaced in a manner unique to each marker so that the identity of a marker is apparent from the location of the lights.

24. The marker defined in claim 17 wherein said signaling means incorporates vertically disposed lenticular lens.

25. The marker defined in claim 17 wherein said marker incorporates difussive means in the body.

26. The marker defined in claim 1 further including a physical protuberance being located on said main body in a manner unique to each marker so the identity of a marker is apparent from location of the protuberance.

27. The marker defined in claim 1 wherein the signaling means further comprises control means for causing said planes of light to be emitted from said signaling means according to a predetermined sequence.

28. The marker defined in claim 27 wherein the control means causes the planes of light to be emitted in a vertical sequence.

29. A marker comprising:

a base, an upright elongate main body mounted on said base, and one or more signaling means including a primary light source in said main body, said signaling means being vertically disposed along the main body, said signaling means emitting light from said main body throughout 360 degrees in vertically displaced areas and in planes which are essentially horizontal, and further including a vertically oriented elongated low intensity light source in said main body, said low intensity light source being energized separately from said primary light source.

30. The marker of claim 29 wherein the primary light source is a high intensity light source comprising a gas discharge light source.

31. A marker comprising:

a base, an upright elongate main body mounted on said base, and one or more signaling means including a primary light source in said main body, said signaling means being vertically disposed along the main body, said signaling means emitting light from said main body throughout 360 degrees in vertically displaced areas and in planes which are essentially horizontal, wherein said signaling means include a plurality of light redirecting means to direct light emission from the primary light source into the horizontal plane, and wherein said redirecting means are mounted on a bracket and are frustoconical in shape, said reflecting means being annular and being sized so that each is larger than a superjacent redirecting means.

32. The marker defined in claim 31 wherein the signaling means includes one or more Fresnel lenses to direct light in horizontal planes.

33. The marker defined in claim 31 further including a vertically-directed reflector in said main body.

34. A marker comprising:

a base, an upright elongate main body mounted on said base, and one or more signaling means including a primary light source in said main body, said signaling means being vertically disposed along the main body, said signaling means emitting light from said main body throughout 360 degrees in vertically displaced areas and in planes which are essentially horizontal, wherein said signaling means include a plurality of light redirecting means to direct light emission from the primary light source into the horizontal plane, and wherein said redirecting means comprises plural prisms mounted on said main body.

35. The marker defined in claim 34 further including a vertically-directed light reflector in said main body.

36. The marker defined in claim 34 further including a reflecting cone in said main body.

37. The marker defined in claim 29, 17 or 34, the signalling means further comprising one or more fresnel lenses to direct light in horizontal planes.

38. The marker defined in claim 29, 17 or 34 further comprising a cap on top of the body and a bird spike on top of the cap and proceeding upward therefrom along a longitudinal center line of the marker.

39. The marker defined in claim 31 or 34 further including a reflecting cone in said main body.

40. A marker comprising:

a base, an upright elongate main body mounted on said base, and one or more signaling means including a primary light source in said main body, said signaling means being vertically disposed along the main body, said signaling means emitting light from said main body throughout 360 degrees in vertically displaced areas and in planes which are essentially horizontal, wherein the primary light source is a high intensity light source, and further comprising a low intensity light source, and wherein the low intensity light source is floures-cent.

41. The marker of claim 40 wherein the high intensity light source is a gas discharge light source.

* * * * *